US009085899B1

(12) United States Patent
Bertrand

(10) Patent No.: US 9,085,899 B1
(45) Date of Patent: Jul. 21, 2015

(54) GEOMEMBRANE TO CONCRETE AFFIXING SYSTEM AND METHOD

(71) Applicant: Poly-America, L.P., Grand Prairie, TX (US)

(72) Inventor: Anthony H Bertrand, Mansfield, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

(21) Appl. No.: 14/330,489

(22) Filed: Jul. 14, 2014

(51) Int. Cl.

| | |
|---|---|
| ***E04C 2/26*** | (2006.01) |
| ***E04C 2/296*** | (2006.01) |
| *E04C 3/29* | (2006.01) |
| *E04C 2/288* | (2006.01) |

(52) U.S. Cl.
CPC ..... *E04C 2/296* (2013.01); *E04C 2/288* (2013.01); *E04C 3/29* (2013.01)

(58) Field of Classification Search
CPC ..... E04C 2/205; E04C 2/22; E04C 2/288; E04C 2/296; E04C 3/29
USPC ..... 52/309.7, 309.16, 443
See application file for complete search history.

(56) References Cited

U.S. PATENT DOCUMENTS

| | | | | |
|---|---|---|---|---|
| 1,956,354 | A * | 4/1934 | Junkers | 52/425 |
| 4,678,375 | A * | 7/1987 | Gagle et al. | 405/270 |
| 4,980,934 | A * | 1/1991 | Dahowski et al. | 4/496 |
| 5,763,047 | A | 6/1998 | Green | |
| 6,182,412 | B1 * | 2/2001 | Traxler | 52/517 |
| 6,524,029 | B2 * | 2/2003 | Nobert et al. | 405/129.75 |
| RE39,922 | E * | 11/2007 | Rainey | 405/262 |
| 7,374,059 | B2 * | 5/2008 | Morgan et al. | 220/216 |
| 7,686,903 | B2 | 3/2010 | Muncaster et al. | |
| 8,029,376 | B2 * | 10/2011 | Shaneour et al. | 472/92 |
| 8,226,491 | B2 * | 7/2012 | Shaneour et al. | 472/92 |
| 8,608,883 | B2 | 12/2013 | Blasdel et al. | |
| 8,622,654 | B2 * | 1/2014 | Oliveira | 405/129.75 |
| 8,864,423 | B2 * | 10/2014 | Oliveira | 405/270 |
| 2001/0002497 | A1 * | 6/2001 | Scuero | 14/73 |
| 2003/0066789 | A1 * | 4/2003 | Morgan et al. | 210/120 |
| 2003/0070391 | A1 * | 4/2003 | Tachauer et al. | 52/745.21 |
| 2004/0065033 | A1 * | 4/2004 | Bleibler | 52/309.7 |
| 2009/0183444 | A1 * | 7/2009 | Wilkerson et al. | 52/169.5 |
| 2012/0045286 | A1 * | 2/2012 | Oliveira | 405/302.7 |

* cited by examiner

*Primary Examiner* — Andrew J Triggs
(74) *Attorney, Agent, or Firm* — Daniel J. Layden; Brandon J. Lee

(57) ABSTRACT

The present disclosure describes systems and methods for affixing one or more geomembrane sheets to a concrete slab. The systems and methods can include an affixing member that adheres to the one or more geomembrane sheets. The affixing member can further include gripping extensions that adhere to the concrete slab. The gripping extensions can include distal ends embedded into the concrete slab. The gripping extensions can be integral with the affixing member. The geomembrane sheets may be used in the construction of a building to prevent vapor transmission through a concrete foundation from the supporting substrate.

20 Claims, 7 Drawing Sheets

GEOMEMBRANE TO CONCRETE AFFIXING SYSTEM AND METHOD

CROSS-REFERENCE TO RELATED APPLICATIONS

Not applicable.

BACKGROUND OF THE INVENTION

1. Field of the Invention

The present invention relates to a system and method of affixing geomembrane to concrete. Specifically, the present disclosure relates to a system and method of utilizing an affixing member to affix geomembrane to concrete slabs used in the construction industry. The geomembranes are utilized for retarding vapor from entering a building from underneath the concrete slab of a building's foundation.

2. Description of the Related Art

A geomembrane is a low permeability synthetic membrane liner or barrier used to prevent the transmission of fluid or gas into a structure that is in contact with the ground. Since concrete is porous, it fails to prevent the transmission of gaseous contaminants into a structure on its own. Thus, geomembranes are used in the construction of buildings to prevent the transmission of water vapor and other contaminants from entering into the building through a concrete foundation that is in contact or in proximity to the ground. Geomembranes are often constructed of polymeric films in sheet form and, in particular, are often times constructed out of polyethylene films. Geomembranes used for preventing vapor transmission through a concrete foundation are often referred to as vapor barriers or vapor retarders.

For a building foundation requiring a vapor barrier or vapor retarder, more than one sheet of geomembrane is typically required to cover the entire area of the building's foundation. As a result, geomembrane sheets commonly are laid adjacent to each other to cover the entire area of the foundation. The individual sheets are typically overlapped and joined to each other with the use of seaming tape. Typical seaming tape adheres the geomembrane sheets to each other but fails to provide any adhesion to the concrete slab of the foundation. Furthermore, the typical polymeric film used as a geomembrane fails to adhere to the concrete slab and may only be held in place by the supporting substrate of the construction site, such as the ground.

Building designers are increasingly concerned that geomembranes may not adequately be held in place against a concrete slab of a building's foundation as the ground or other supporting substrate of the foundation shifts over time. Additionally, buildings are increasingly being constructed with the use of temporary support platforms in regions with expansive soils. The temporary support platforms are used to create space between concrete foundations and expansive soils. The temporary support platforms are laid upon the ground prior to the pouring of concrete. Once the concrete hardens, the temporary support platforms gradually absorb moisture, lose strength, and deteriorate, leaving space between the ground and the concrete slab. The concrete remains supported by piers or other structural supports. Typically, a geomembrane is placed on the temporary support platforms prior to pouring the concrete. However, once the temporary support platforms deteriorate, the sheeting may not be adequately held in place against the concrete slab. An improved system and method is required to hold the geomembrane in contact with the concrete slab without support from the underlying substrate.

An example of a method of adhering a geomembrane to concrete is disclosed in U.S. Pat. No. 8,608,883 B2 (the '883 patent) entitled "Adherent Layer." The '883 Patent discloses an "adherent layer" that has a substrate, a first adhesive layer applied to the top of the substrate, a second adhesive layer applied to a bottom of the substrate, and a textured layer applied to the top of the substrate and over the first adhesive layer. The '883 patent further discloses that this adherent layer can be attached to a geomembrane acting as a vapor barrier and concrete can then be poured on to the adherent layer. According to the disclosure, a mechanical bond is formed between the concrete slab and the textured layer of the adherent layer, adhering the geomembrane to the concrete slab. However, in the '883 patent, an adhesive is required to adhere the textured layer to the tape substrate. Therefore, there is an increased risk that the geomembrane will not remain adhered to the concrete slab if the adhesive bond fails.

U.S. Pat. No. 7,686,903 B2 (the '903 patent) provides an example of affixing a geomembrane to concrete slabs and other building structures. The '903 patent discloses a composite membrane with a layer of rubberized asphalt, a plastic film layer, and a layer of nonwoven geotextile. The nonwoven geotextile forms a mechanical bond between the membrane and concrete when the concrete is formed on the membrane. The thickness of the entire membrane can range from about 30 to 95 mils. This disclosed geomembrane may be thicker than desired for certain applications and may not be a cost effective solution for all applications.

In view of the foregoing, it is desired to provide a cost effective solution that addresses the need for affixing a geomembrane to a concrete slab and provides an improved bond.

SUMMARY OF THE INVENTION

The present invention is directed to a system for affixing a geomembrane to a concrete slab. The system may comprise one or more sheets of geomembrane and an affixing member. In a preferred embodiment, the one or more sheets of geomembrane may comprise a polyethylene material or various other polymers. The affixing member may comprise an affixing substrate and an adhesive on a first side of the affixing substrate. The adhesive may adhere to at least the perimeter of the one or more sheets of the geomembrane. The adhesive may be capable of adhering to polyethylene film. The affixing member may further comprise a plurality of gripping extensions. The plurality of gripping extensions may be embedded into the concrete slab. The plurality of gripping extensions may be integral with the affixing substrate and extend from a second side of the affixing substrate. The one or more sheets of geomembrane may have a first side that adheres to the affixing member and a second side that may be supported by a supporting substrate.

In a preferred embodiment, the affixing substrate and the plurality of gripping extensions may be formed from a homogeneous material. The plurality of gripping extensions may comprise a distal end and the distal end may be hooked shape. The plurality of gripping extensions may be organized into a plurality of rows. One hooked shaped distal end may be aligned in an opposite direction from adjacent gripping extensions located in the same row. The hook shaped distal ends may also be aligned along a single axis where the single axis may be parallel or perpendicular to a length of the affixing member.

It is further contemplated that the geomembrane affixing system may further comprise two or more sheets of geomembrane. A first sheet of the two more sheets of geomembrane may overlap a second sheet of the two or more sheets. The affixing member may further be applied to an edge portion of the first sheet and a portion of the second sheet. The portion of the second sheet may be located in proximity to an edge of the second sheet.

The present invention is also directed toward a method for affixing geomembrane to concrete. The method may include affixing a first side of an affixing member to a perimeter of one or more sheets of a geomembrane. The method may further include pouring concrete onto the perimeter of the one or more sheets. A plurality of gripping extensions may extend from a second side of the affixing member and be embedded into the concrete. The plurality of gripping extensions and an affixing substrate of the affixing member may be constructed of a solitary material. The plurality of gripping extensions may be organized into a plurality of rows. Each of the plurality of gripping extensions may further have a distal end. The distal end of each of the plurality of gripping extensions may be hooked shaped. A first hook shaped distal end may be aligned in an opposite direction from an adjacent second hook shaped distal end. The hook shaped distal ends of the plurality of gripping extensions may further be oriented along a single axis. The single axis may be aligned parallel or perpendicular to a length of the affixing member.

The method of affixing geomembrane to concrete may further comprise two or more sheets of geomembrane laid adjacent to each other in an overlapping fashion. The affixing member of the method may be applied to an edge portion of at least one of the two or more sheets. The one or more geomembrane sheets used in the method may comprise polyethylene and the adhesive may be capable of adhering to polyethylene.

The present invention is directed to another system for affixing a geomembrane to a concrete slab. The system may comprise one or more sheets of geomembrane and an affixing member. The affixing member may comprise an affixing substrate and an adhesive on a first side of the affixing substrate. The adhesive may adhere to at least the perimeter of the one or more sheets of the geomembrane. The affixing member may further comprise a plurality of gripping extensions extending from a second side of the affixing substrate. Each of the plurality of gripping extensions may comprise a distal end embedded into the concrete slab.

BRIEF DESCRIPTION OF THE RELATED DRAWINGS

A full and complete understanding of the present invention may be obtained by reference to the detailed description of the present invention and the described embodiments when viewed with reference to the accompanying drawings. The drawings can be briefly described as follows.

DETAILED DESCRIPTION OF THE INVENTION

The present disclosure illustrates one or more embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms is not intended to conclusively limit the scope of protection.

Figure 1:
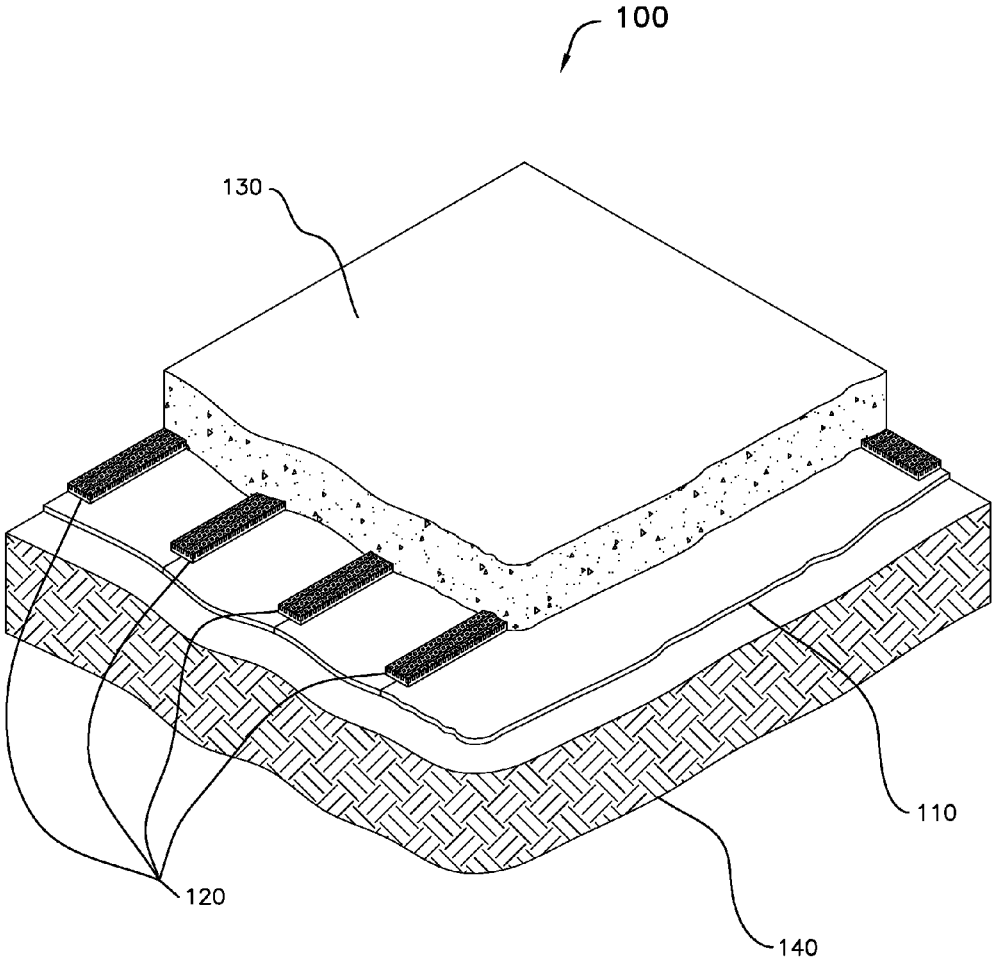
FIG. 1 is a perspective view, partially in cross-section, of an embodiment of the present invention with certain features shown not to scale so as to better illustrate the invention.

Looking initially at FIG. 1, an embodiment of a geomembrane to concrete sheet affixing system 100 is shown. The system 100 has one or more geomembrane sheets 110 and one or more affixing members 120. FIG. 1 further shows a concrete slab 130 and a supporting substrate 140. The supporting substrate may be soil, a plurality of temporary support platforms or any other substrate capable of supporting the one or more geomembrane sheets 110 against the concrete slab 130. The supporting substrate 140 may only provide temporary support and may eventually fail to maintain the geomembrane 110 in place against the concrete slab 130.

Figure 2:
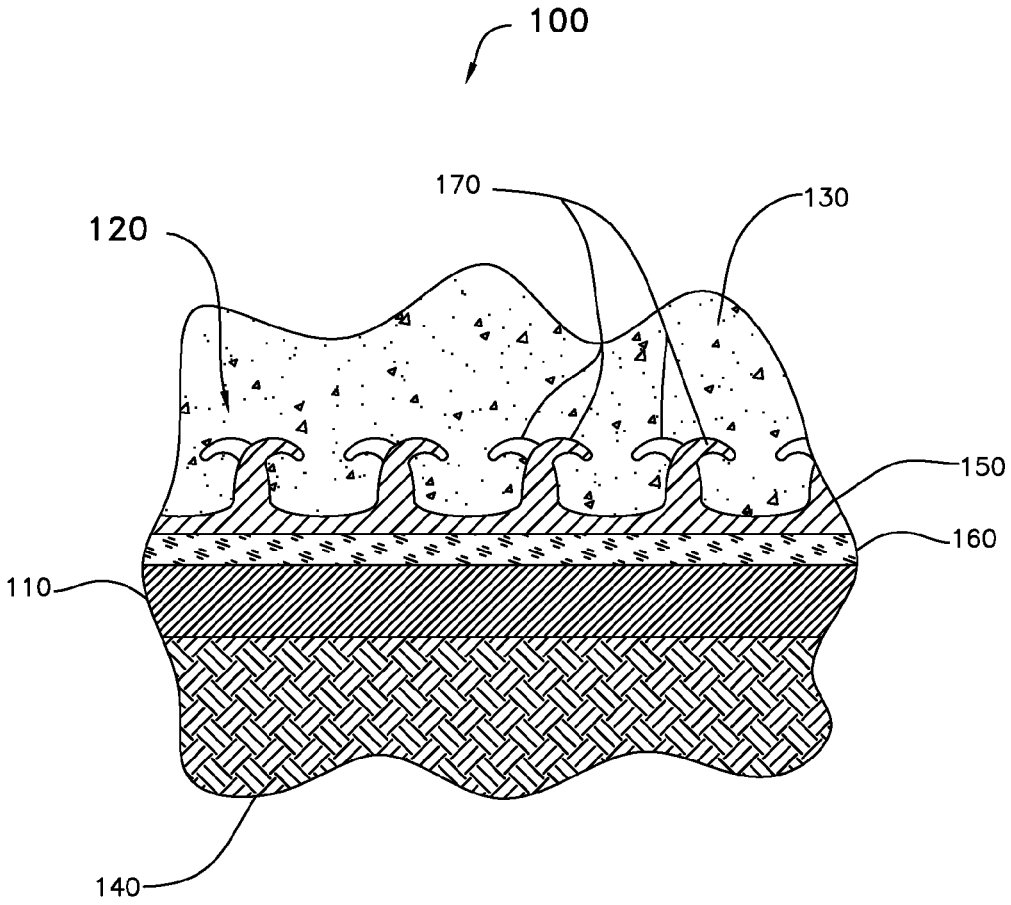
FIG. 2 is a detailed side view of the embodiment shown in FIG. 1.

In FIG. 2, an adhesive 160 of the affixing member 120 is shown with the adhesive 160 on a first side of the affixing substrate 150. The adhesive 160 is shown adhering the affixing member 120 to the geomembrane 110. FIG. 2 further shows a plurality of gripping extensions 170 extending from a second side of the affixing substrate 150. The plurality of gripping extensions 170 is shown embedded into the concrete slab 130. Each of the gripping extensions 170 includes a distal end embedded into the concrete slab 130. The distal ends of the gripping extensions 170, in a preferred embodiment, are hook shaped as shown in FIG. 2. The gripping extensions 170 are proportioned and spaced so that typical grades of concrete substantially flow around and surround each gripping extension 170.

Figure 3:
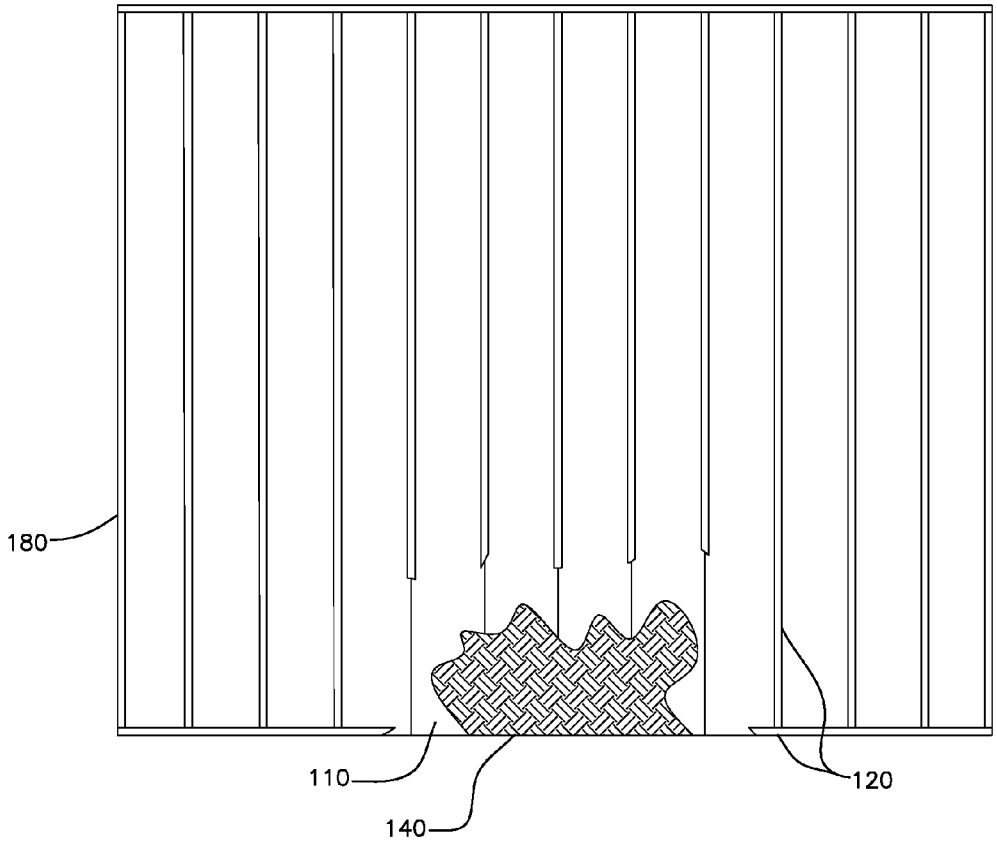
FIG. 3 is a cutaway top view of the embodiment of FIG. 1 with certain sections partially removed and the concrete slab not shown to better illustrate certain aspects of the invention.

Certain aspects of the concrete to geomembrane affixing system 100 are shown more thoroughly in FIG. 3. FIG. 3 shows a perimeter 180 defined by a plurality of sheets of a geomembrane 110. The perimeter 180 shown by FIG. 3 is generally rectangular in shape. However, the perimeter 180 may take on any shape as required for a particular installation. The affixing member 120 is shown adhered to the perimeter 180 of the geomembrane sheets 110. Each one of the geomembrane sheets 110 is arranged so that a lengthwise edge portion of each sheet is adjacent to another sheet. In a preferred embodiment, the affixing member 120 is further used to affix the geomembrane sheets 110 to the concrete at any penetrations that pass through the geomembrane sheets 110.

Figure 4:
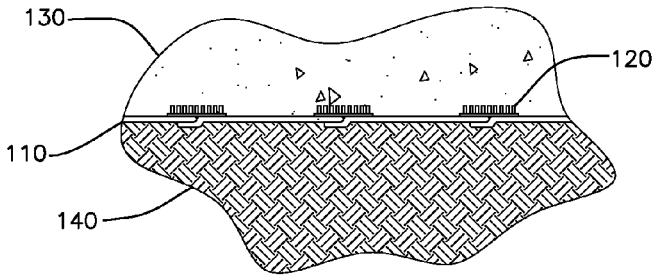
FIG. 4 is a partial elevation view of the embodiment shown in FIGS. 1 and 2, not to scale.

As more clearly shown in FIG. 4, the geomembrane sheets 110 may be laid next to each other in an overlapping fashion so that an edge portion of one sheet is in contact with or adjacent to a portion of another sheet. As shown in FIGS. 3 and 4, the affixing member 120 may be applied to an edge portion of a first sheet and to a portion of a second sheet. The portion of the second sheet that the affixing member 120 is applied to may be in proximity to the edge of the second sheet. With the affixing member 120 applied to the perimeter 180 and to portions of adjacent sheets as shown in FIG. 3, the system 100 may affix numerous geomembrane sheets 110 to a concrete slab 130 of any size. The geomembrane sheets 110 may be cut to size to fit the dimensions of the concrete slab 130 as dictated by the requirements of a particular installation.

Figure 5:
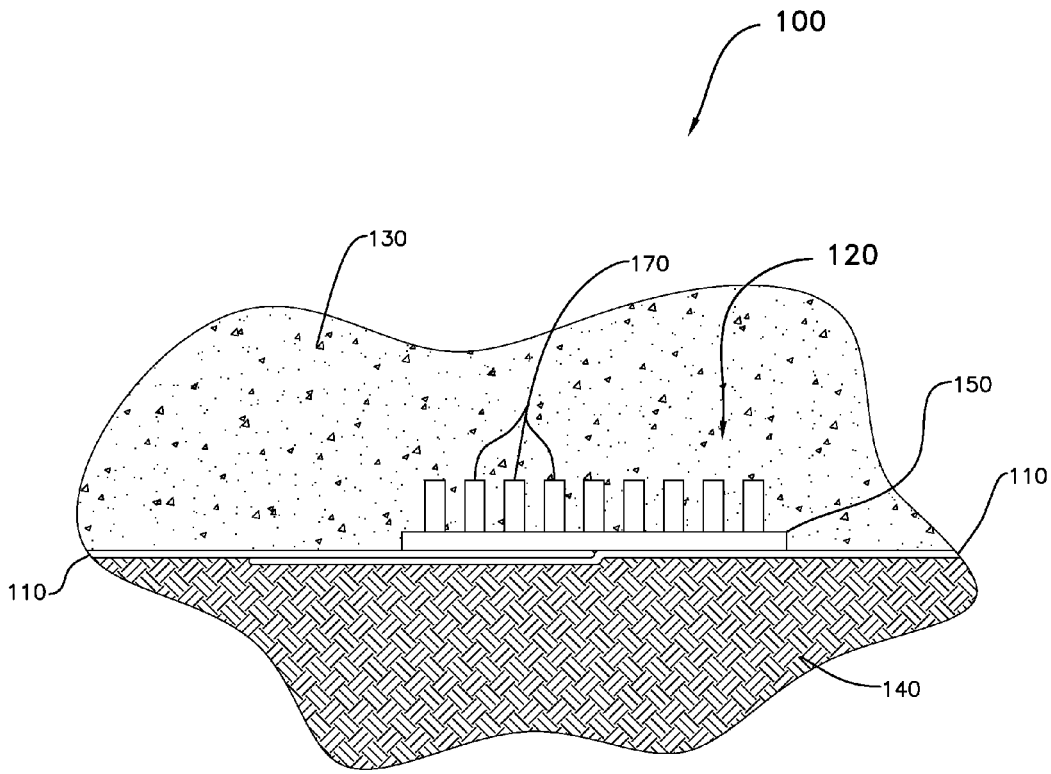
FIG. 5 is a partial front view of the embodiment shown in FIG. 1.

FIG. 5 shows a detailed partial front view of certain aspects of the geomembrane to concrete affixing system 100. The affixing member 120 is not shown to scale. The gripping members 170 are shown embedded into the concrete 130. The geomembrane 110 is shown supported by the supporting substrate 140. A first sheet of the geomembrane 110 is shown arranged in an overlapping fashion to a second sheet of the geomembrane 110. In one preferred embodiment, the first sheet may overlap the second sheet by a minimum of six inches; however, it is contemplated that the overlap distance may vary considerably.

Figure 6:
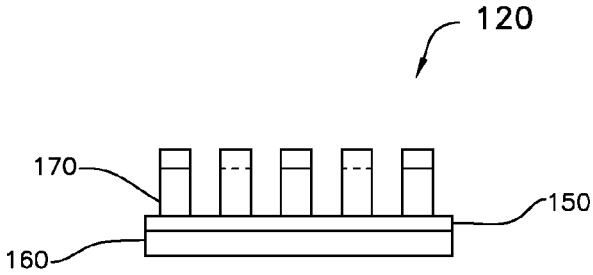
FIG. 6 is a detailed partial front view of the affixing member utilized in the invention, with certain aspects not to scale.
Figure 7:
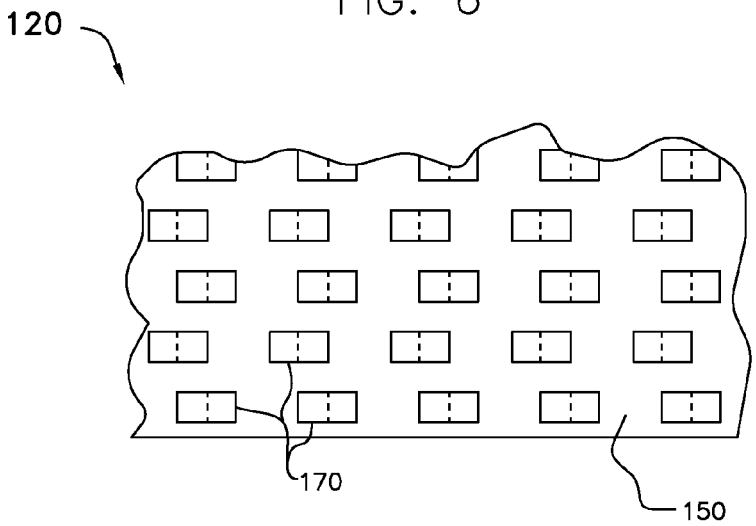
FIG. 7 is a partial top view of the affixing member shown in FIG. 6.
Figure 8:
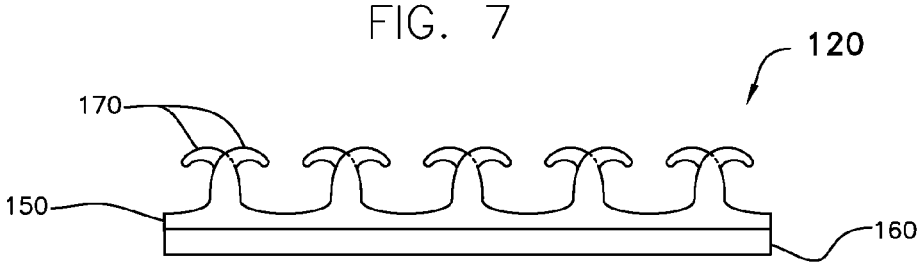
FIG. 8 is a side view of the affixing member shown in FIG. 6.

FIGS. 6-8 illustrate in further detail one preferred embodiment of the affixing member 120. The height of each gripping extension 170 from the surface of the affixing substrate 150 may be within the range of 0.80 millimeter (mm) to 1.00 mm. Each of the gripping extensions 170 may comprise a rectangular cross-section. Each of the gripping extensions 170 may taper in width as the height of each gripping extension 170 increases in relation to the surface of the affixing substrate 150 as shown in FIG. 8.

In a certain embodiment, the gripping extensions 170 of the affixing member 120 shown in FIGS. 6-8 may be sized and arranged so that for each square centimeter ($cm^2$) there are 84 gripping extensions 170, preferably arranged in a 6 by 14 layout per each square centimeter. Thus, the affixing member 120 may be constructed so that for every centimeter (cm) of width there are 14 gripping extensions 170. In one preferred embodiment, the width of the affixing member 120 may be approximately 15.25 cm so that there are approximately 214 gripping extensions 170 for each row of gripping extensions 170.

The plurality of gripping extensions 170 may be organized into rows as illustrated by FIG. 7. As detailed in FIG. 7, each gripping extension 170 can be organized into rows from a first side to a second side of the width of the affixing member 120. Each adjacent gripping extension 170 may have a hooked shaped distal end as illustrated by FIG. 8. Within each row, the location of the base of each gripping extension 170 may be aligned as shown in FIGS. 7 and 8. The curvature of the distal end of each gripping extension 170 may be aligned along a single axis. The axis may be aligned parallel to the length of the affixing member 120 as illustrated by FIG. 7. Alternatively, the axis may be aligned transverse to the length of the affixing member 120. Within a row, the hook shaped distal end of each adjacent gripping extension 170 may be oriented in an opposite direction as shown by FIGS. 7 and 8.

The thickness of the affixing substrate 150 may be approximately 0.14 mm and the thickness of the adhesive 160 may be approximately 0.20 mm. The adhesive 120 of the affixing member 120 may be a butyl rubber compound or any other adhesive that provides adequate adhesion between the affixing substrate 150 and the geomembrane 110. As shown in FIG. 8, a surface of the affixing substrate 150 may vary in height, decreasing in height between each gripping extension 170 and sloping up when approaching each gripping extension 170. In a preferred embodiment, the total width of the affixing member 120 may be approximately six inches but may vary considerably. Preferably, the length of the affixing member 120 will be much longer than the width. However, the exact length may vary a great degree, depending upon the particular application.

Figure 9:
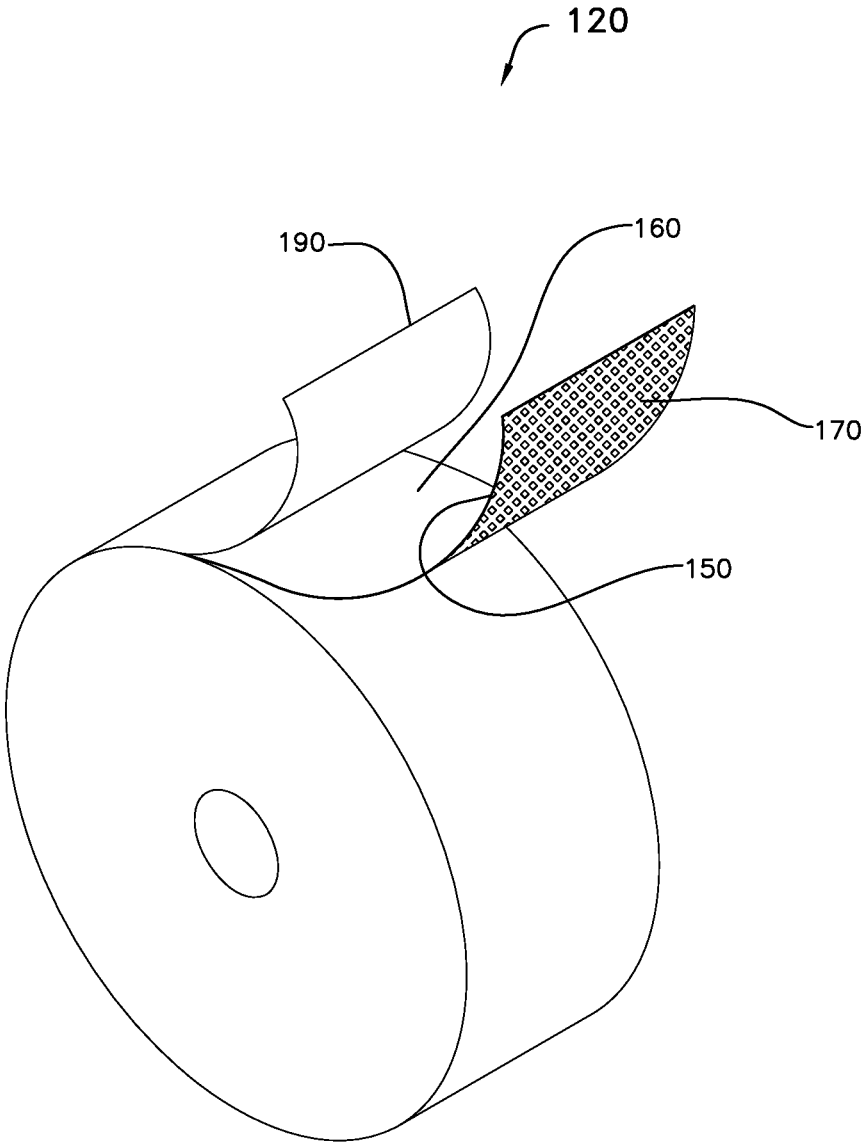
FIG. 9 is a perspective view of a roll of a preferred embodiment of the affixing member.

FIG. 9 illustrates an embodiment of the affixing member 120 configured into a roll. FIG. 9 further illustrates that the affixing member 120 may include a releasable backing 190 that prevents the affixing member 120 from sticking to itself when configured into a roll. The releasable backing 190 may be constructed of a coated paper. FIG. 9 shows the adhesive 160 located on a first side of the affixing substrate 150 of the affixing member 120. Further depicted in FIG. 9 are the gripping extensions 170 located on a second side of the affixing substrate 150.

In one preferred embodiment, the gripping extensions 170 of the affixing member 120 and the affixing substrate 150 are a single monolithic and continuous structure, as shown by FIG. 2, so that the gripping extensions 170 are integral with the affixing substrate 150. This integral structure prevents the gripping extensions 170 from detaching from the affixing member 120. This monolithic structure may be formed as a cast polypropylene material. However, the structure may be formed from any other suitable polymer or other material and manufactured by any suitable process known in the art. The gripping extensions 170 and affixing substrate 150 may also be formed together from a homogeneous material or a solitary material.

As mentioned, in a preferred embodiment, the distal end of each of the gripping extensions 170 may be hooked shaped. As shown in FIGS. 2 and 8, each gripping extension 170 may extend above the surface of the affixing substrate 150 a majority of its height in a general perpendicular fashion relative to a plane of the affixing substrate 150, and thereafter begin to curve into an arcuate shape with the curvature exceeding 90 degrees. However, it is contemplated that the curvature of a gripping member 170 may be less than 90 degrees and still fall within the description of a hook shaped distal end. With the curvature exceeding 90 degrees, the distal end portion of a gripping extension 170 points back towards a surface of the affixing substrate 150.

Due to this amount of curvature as described above, once the concrete slab 130 is poured and cures, the shape of the gripping extensions 170, in cooperation with the cured concrete, form an extremely strong bond due to mechanical interference. Thus, the gripping extensions 170 must either deform excessively, due to extreme forces, for the gripping extensions 170 to be detached from the concrete slab 130, or the concrete material itself must fail.

In a preferred embodiment, the plurality of gripping extensions 170 may be integrally formed with the affixing substrate 120 and each of the gripping extensions 170 may comprise a hook shaped distal end. This combination of features prevents the gripping extensions 170 from separating from the concrete slab 130 and also prevents the gripping extensions 170 from separating from the affixing member 120. Thus, such an embodiment is capable of providing an exceptionally strong bond to the concrete slab 130.

The strength of the bond between the affixing member 120 and concrete 130 has been demonstrated through industry accepted testing according to ASTM D903. By this testing, a preferred embodiment with the previously described affixing member 120 has been shown to achieve 180 degree peel adhesion strength in excess of 25 lb/in. Additionally, the sheer adhesion strength of a 1 inch by 2 inch sample of the affixing member 120 embedded in concrete has been shown to achieve test results of greater than 56.0 lb/in$^2$.

In a preferred embodiment of the present invention, the geomembrane 110 may be comprised of polymeric film. The thickness of the film may vary but it may be in a range from 10 to 15 mils. The film may have multiple layers. A multilayer film may be formed by coextrusion of various polyolefin resins. Each layer of a coextruded film may comprise a different polyolefin resin. The film, in an alternative embodiment, may be constructed of a single layer.

In a certain embodiment the polymeric film may be a polyethylene film. The polyethylene film may comprise Very Low Density Polyethylene (VLDPE), Low Density Polyethylene (LDPE), Linear Low Density Polyethylene (LLDPE), Metallocene Based Very Low Density Polyethylene (MV-LDPE), High Density Polyethylene (HDPE), or any combination of the foregoing. The polyethylene film may comprise multiple layers or a single layer.

Figure 10:
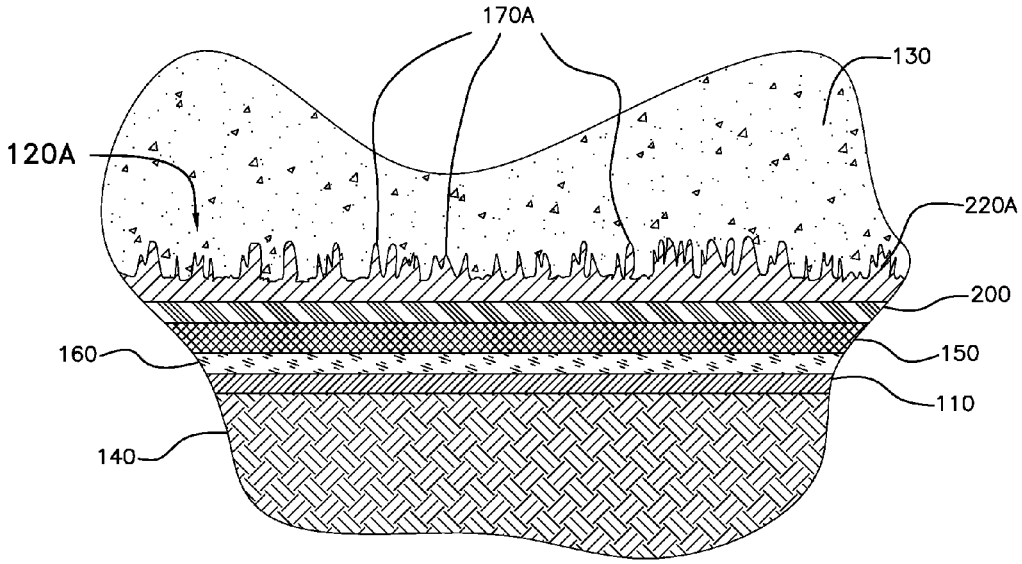
FIG. 10 is a cross-sectional side view of an alternative embodiment of the invention.

Another embodiment of the present invention is disclosed in FIG. 10. FIG. 10 shows an alternative affixing member 120A. The affixing member 120A is shown having an affixing substrate 150 and a gripping adhesive 200 on a first side of the affixing substrate 150. A gripping member 220A is shown adhered to the gripping adhesive 200. The gripping member 220A may include a first surface that adheres to the gripping adhesive 200. The first surface may generally be laminar and flat to enable it to adhere appropriately to the gripping adhesive 200. A second surface of the gripping member 220A may be rough, jagged, and irregular in shape. The second surface of the gripping member 220A may comprise a plurality of irregular peaks and valleys. The distal ends of the irregular peaks may form a plurality of irregular shaped gripping extensions 170A. The plurality of gripping extensions 170A is shown embedded within the concrete slab 130 in FIG. 10, affixing the affixing member 120A to the concrete 130. The irregular second surface of the gripping member 220A may be formed in a polyolefin film by the use of blowing agents in the manufacturing process.

Further illustrated by FIG. 10 is an adhesive 160 on a first side of the affixing substrate 150. The adhesive 160 is shown adhering the affixing member 120A to one or sheets of a geomembrane 110. The geomembrane sheets 110 are shown supported by a supporting substrate 140.

Figure 11:
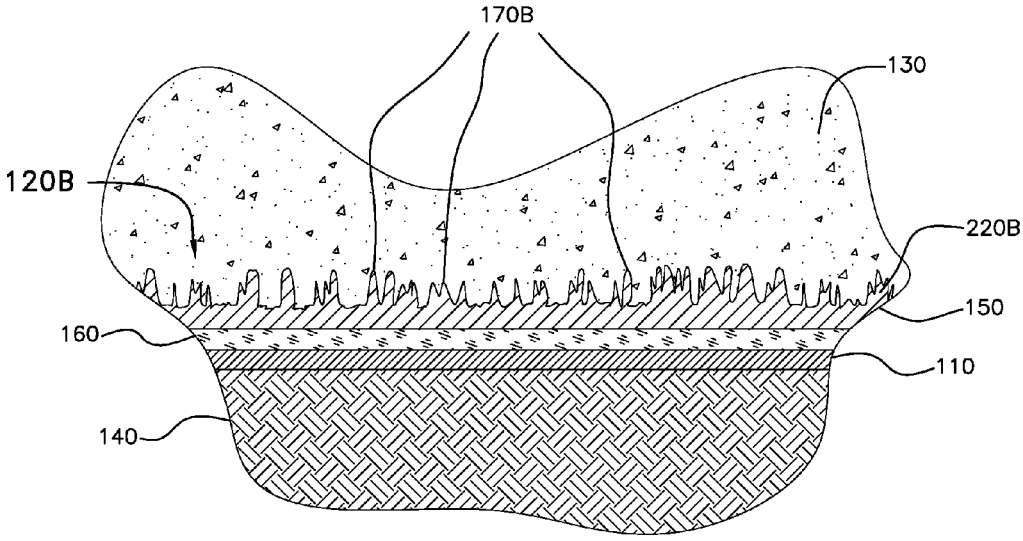
FIG. 11 is a cross-sectional side view of another alternative embodiment of the invention.

FIG. 11 depicts another embodiment of the present invention. FIG. 11 shows an alternative affixing member 120B. The affixing member 120B is shown with an affixing substrate 150. A gripping member 220B is shown extending from the affixing substrate 150. A second surface of the gripping member 220B may comprise a plurality of irregular peaks and valleys. The distal ends of the irregular peaks may form a plurality of irregular shaped gripping extensions 170B. The plurality of gripping extensions 170B are shown embedded within concrete 130 in FIG. 11, affixing the affixing member 120B to the concrete 130. The gripping member 120B and the affixing substrate 150 may be formed from a solitary and continuous material. Thus, the gripping member 120B may be integral with the affixing substrate 150. The irregular second surface of the gripping member 220B may be formed in a polyolefin film by the use of blowing agents in the manufacturing process.

Further illustrated by FIG. 11 is an adhesive 160 on a first side of the affixing substrate 150. The adhesive 160 is shown affixing the affixing member 120B to one or sheets of a geomembrane 110. The geomembrane sheets 110 are shown supported by a supporting substrate 140.

As previously noted, the specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

I claim:

1. A geomembrane to concrete slab affixing system comprising:

one or more sheets of a geomembrane; and an affixing member comprising:

an affixing substrate, an adhesive on a first side of the affixing substrate adhering the affixing member to a perimeter of the one or more sheets, a plurality of gripping extensions, each gripping extension comprising a base extending from a planar surface of a second side of the affixing substrate, at least one of the bases of the gripping extensions extending generally perpendicularly from the planar surface of the second side of the affixing substrate and defining a vertical axis, a distal end of the at least one of the gripping extensions extending horizontally in only a single direction away from the vertical axis of the base of the gripping extension, and the plurality of gripping extensions embedded into the concrete slab.

2. The concrete slab to geomembrane affixing system of claim 1 wherein the affixing substrate and the gripping extensions are formed from a homogeneous material.

3. The concrete slab to geomembrane affixing system of claim 1 wherein each of the plurality of gripping extensions comprises a hooked shaped distal end with a curvature exceeding 90 degrees and pointing towards the affixing substrate.

4. The concrete slab to geomembrane affixing system of claim 3 wherein the plurality of gripping extensions is organized into a plurality of rows and each gripping extension is oriented in an opposite direction from each adjacent gripping extension within each plurality of rows.

5. The concrete slab to geomembrane affixing system of claim 3 wherein an orientation of the hooked shaped distal end of each of the plurality of gripping extensions is along a single axis.

6. The concrete slab to geomembrane affixing system of claim 5 wherein the single axis is parallel to a length of the affixing member.

7. The concrete slab to geomembrane affixing system of claim 5 wherein the single axis is perpendicular to a length of the affixing member.

8. The concrete slab to geomembrane affixing system of claim 1 further comprising:

the one or more sheets comprising two or more sheets of geomembrane, a first sheet of the two or more sheets overlapping a second sheet of the two or more sheets, and the affixing member applied to an edge portion of the first sheet and a portion of the second sheet.

9. The concrete slab to geomembrane affixing system of claim 1 wherein the one or more sheets comprise polyethylene and the adhesive comprises an adhesive capable of adhering to polyethylene.

10. A method of affixing geomembrane to concrete comprising the steps of:

adhering a first side of an affixing member to a perimeter of one or more sheets of a geomembrane with an adhesive; and pouring concrete onto the perimeter of the one or more sheets, wherein a plurality of gripping extensions extend from a second side of the affixing member and are embedded into the concrete, and at least one of the gripping extensions having a base and a distal end, the base extending vertically from the affixing member, the distal end extending horizontally in only a single direction away from the base of the gripping extension.

11. The method of claim 10 wherein the affixing member further comprises an adhering substrate that is formed with the plurality of gripping extensions as a solitary material.

12. The method of claim 10 wherein the distal end of the at least one gripping extension is hook shaped with a curvature exceeding 90 degrees and pointing towards the affixing substrate.

13. The method of claim 12 wherein each gripping extension is aligned in an opposite direction from each adjacent gripping extension.

14. The method of claim 12 wherein an orientation of each of the plurality of gripping extensions is along a single axis.

15. The method of claim 14 wherein the single axis is parallel to a length of the affixing member.

16. The method of claim 14 wherein the single axis is perpendicular to a length of the affixing member.

17. The method of claim 10 further comprising:

two or more sheets of geomembrane laid adjacent to each other in an overlapping fashion, and the affixing member applied to an edge portion of at least one of the two or more sheets.

18. The method of claim 10 wherein the one or more sheets of geomembrane comprises polyethylene and the adhesive is capable of affixing to polyethylene.

19. A geomembrane to concrete slab affixing system comprising:

one or more sheets of a geomembrane; and an affixing member comprising:

an affixing substrate having a first planar surface and a second planar surface opposite the first planar surface, an adhesive on the first planar surface of the affixing substrate adhering the affixing member to a perimeter of the one or more sheets, a plurality of gripping extensions extending from the second planar surface of the affixing substrate, each of the plurality of gripping extensions comprising a distal end embedded into the concrete slab, and at least one of the gripping extensions having a base extending generally perpendicularly from the second planar surface and a distal end extending generally parallel to the second planar surface in only a single direction away from the base.

20. The concrete slab to geomembrane affixing system of claim 19 wherein the plurality of gripping extensions is integral with the affixing substrate.

* * * * *